United States Patent [19]

Graf, Jr.

[11] Patent Number: 4,493,792

[45] Date of Patent: Jan. 15, 1985

[54] METHOD AND APPARATUS FOR MINIMIZING DIVERSION OF RADIOACTIVE SAMPLES FROM A NUCLEAR FUEL SAMPLING SYSTEM

[75] Inventor: Walter A. Graf, Jr., Saratoga, Calif.

[73] Assignee: Electric Power Research Institute, Inc., Palo Alto, Calif.

[21] Appl. No.: 168,792

[22] Filed: Jul. 11, 1980

[51] Int. Cl.[3] ..... G21F 7/06

[52] U.S. Cl. ..... 252/627; 250/506.1; 252/626; 422/159; 422/903

[58] Field of Search ..... 252/626, 627; 70/267; 250/506; 422/903, 159

[56] References Cited

U.S. PATENT DOCUMENTS 2,303,614 12/1942 Claus ..... 70/267

2,837,907 6/1958 Halling et al. ..... 70/267

OTHER PUBLICATIONS

Sellers et al, "Engineered Safeguards System . . . ", Conf-780304-1, (1978).

NEDO-10178, (Dec. 1970).

*Primary Examiner*—Deborah L. Kyle

*Attorney, Agent, or Firm*—Flehr, Hohbach, Test, Albritton & Herbert

[57] ABSTRACT

Method and apparatus for minimizing diversion of radioactive samples from a nuclear fuel sampling system. The apparatus includes a sampler for drawing a radioactive sample from a remote vessel containing nuclear fuel. The sampler is located within a shielding enclosure that has solid walls for preventing direct physical access to the sampler. A tray is located in the wall of the enclosure and is used for translating a sample vessel in and out of the enclosure. The apparatus further includes a time lock escapement that periodically immobilizes the tray for a period of time sufficient to minimize diversion of the radioactive samples.

12 Claims, 3 Drawing Figures

METHOD AND APPARATUS FOR MINIMIZING DIVERSION OF RADIOACTIVE SAMPLES FROM A NUCLEAR FUEL SAMPLING SYSTEM

DESCRIPTION

TECHNICAL FIELD

The invention generally relates to nuclear fuels and, more particularly, to methods and apparatus for drawing radioactive samples from vessels containing radioactive materials.

BACKGROUND ART

There is serious concern throughout the world that with the increasing deployment of reprocessing facilities that there is an increased likelihood of the further proliferation of nuclear weapons. This concern is due to the fact that essentially all reprocessing methods used heretofore are derived from the processes originally developed during or shortly after World War II for producing plutonium for nuclear weapons. These processes are undesirable because they have the potential to make purified fissionable materials available and therefore susceptible to diversion by terrorist groups. In addition, there is international concern because such reprocessing plants could readily be converted over to the extraction of weapons material by a change of intention by a government which had previously pledged by treaty to forego the production of nuclear weapons.

In answer to this threat Milton Levenson and Edwin Zebroski conceived of a process for reprocessing spent nuclear reactor fuel which makes plutonium highly resistant to diversion. Their concept, which is called The CIVEX Process, includes a combination of changes in the method of reprocessing spent fuel and changes in the design of a reprocessing plant. The CIVEX concept is disclosed in the U.S. patent application entitled "METHOD AND APPARATUS FOR PROCESSING SPENT NUCLEAR REACTOR FUEL" Ser. No. 878,392 which was filed on Feb. 16, 1978.

Within a fuel reprocessing facility a sampling station is a major focus for diversion because it is a point where plutonium containing liquid can be obtained directly without arising suspicion. It is also a point where radiation exposure is minimized and where equipment is readily accessable for transporting radioactive materials. A sampling station is a shielded outlet where radioactive samples are taken by plant personnel in order to monitor the status of the process. These samples are taken at sampling stations located throughout the plant. In a typical plant there are between 40 and 50 such sampling stations. Samples are taken at various rates depending on what is being sampled and which step is occurring in the process. Samples are normally taken either hourly, once per shift, or daily.

In the past sampling stations have been designed principally with the objectives of shielding plant personnel from radiation exposure and insuring that representative samples of the process was taken. It is believed that aside from these objectives no attempt has heretofore been made to limit the amount and frequency of the samples taken. It is also believed that no attempt has heretofore been made to control physical access to sampling stations so that the diversion of plutonium containing liquid could be prevented.

The present invention is directed to overcoming one or more of the problems as set forth above.

DISCLOSURE OF THE INVENTION

The present invention contemplates methods and apparatus for minimizing the diversion of radioactive samples from a nuclear fuel sampling system. The apparatus includes a sampler for drawing a sample from a vessel containing nuclear fuel in solution and a enclosure for preventing direct access to the sampler. The apparatus further includes a tray which moves a sample vessel in and out of the shielded enclosure and means for moving the sample vessel within the shielded enclosure. In one aspect of the invention the tray is periodically immobilized and in another aspect the sample vessel moving means is periodically immobilized for periods of time sufficient to minimize the diversion of radioactive samples from the plant.

The present invention overcomes the disadvantages of the prior art by limiting the access of personnel to radioactive samplers in nuclear fuel processing plants. The amount and frequency of sampling is regulated by a time controlled escapement and physical access to the apparatus is restricted.

Other aspects, objects, the advantages of this invention can be obtained from a study of the drawings, the disclosure, and the appended claims.

BEST MODE FOR CARRYING OUT THE INVENTION

Figure 1:
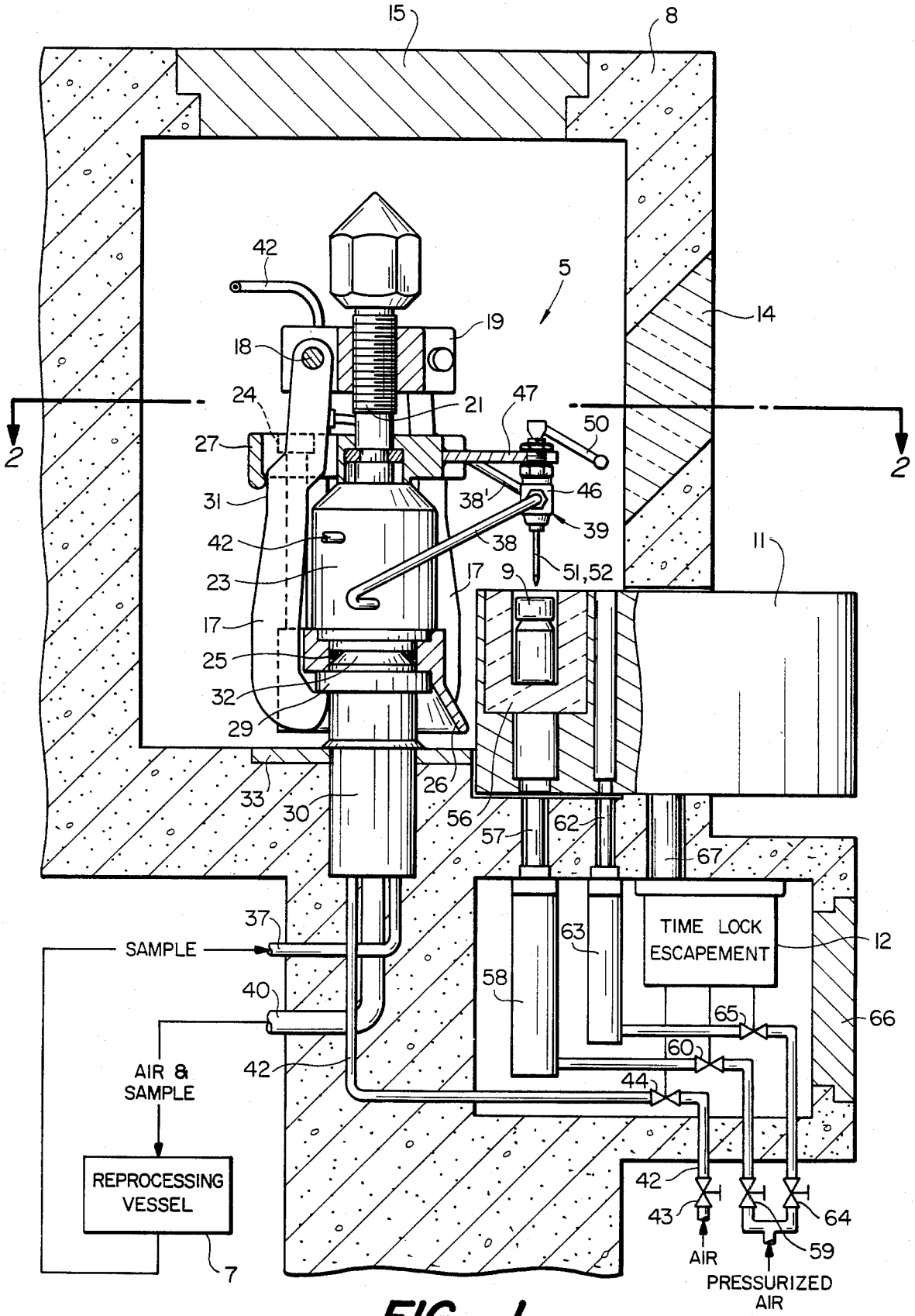
FIG. 1 is a side elevational view, in cross section and broken away, of an embodiment of the present invention.
Figure 2:
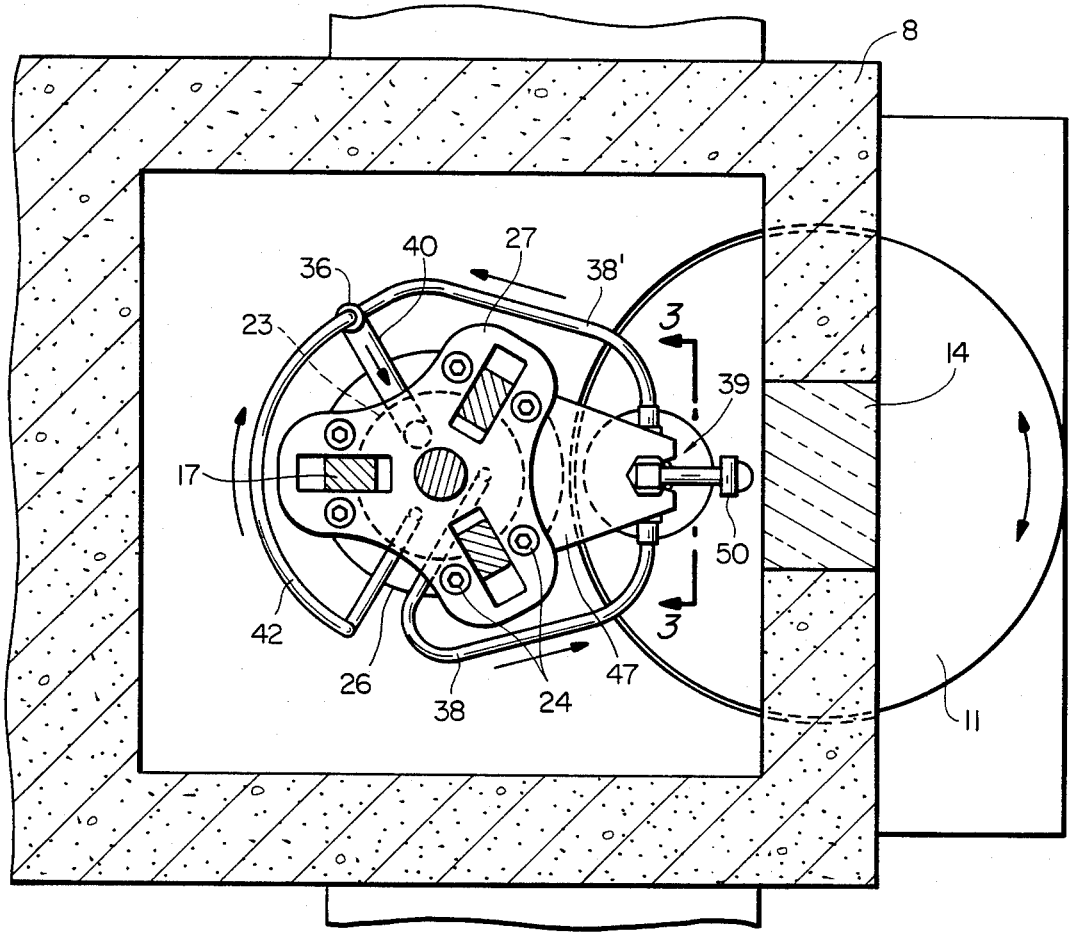
FIG. 2 is a top plan view in cross section and broken away of the embodiment of FIG. 1. The view in FIG. 2 is taken along line 2—2 of FIG. 1.
Figure 3:
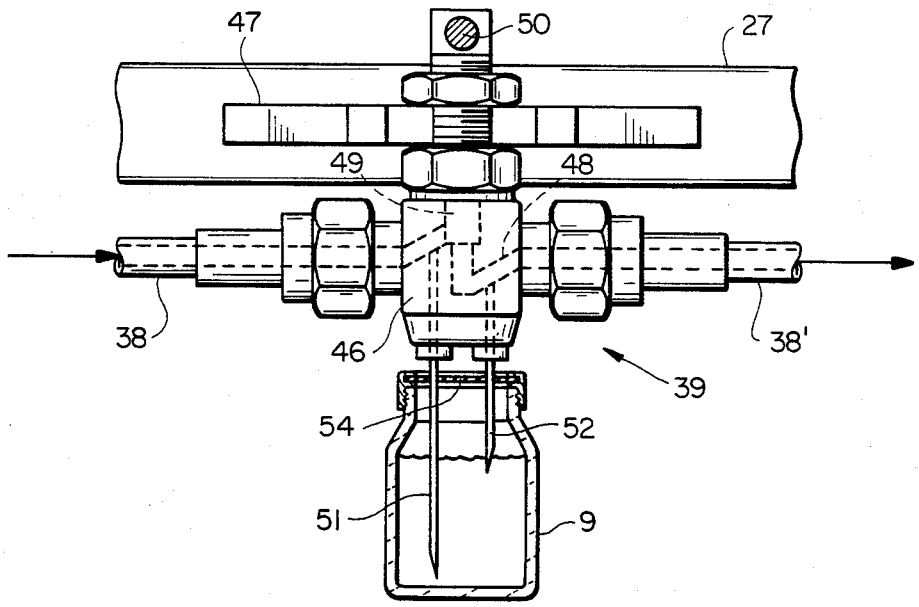
FIG. 3 is a side elevational view, broken away, of the sample needles of the apparatus of FIG. 1. The view of FIG. 3 is taken along line 3—3 of FIG. 2.

FIGS. 1–3 illustrate an apparatus for minimizing the diversion of radioactive samples from a nuclear fuel sampling system. The apparatus includes a sampler 5 for drawing liquid samples from a reprocessing vessel 7. The sampler is surrounded by a shielded enclosure 8 which shields personnel from exposure to radiation and prevents direct physical access to the sampler. The liquid samples are taken in a sample bottle 9 and the sample bottles are inserted and removed from the shielded enclosure using a revolving tray 11. The quantity and frequency of sampling is controlled by a time lock escapement 12 as described in detail below.

Referring to FIG. 1, the shielded enclosure 8 consists of four side walls, a top wall and a bottom wall of conventional construction. The enclosure is fabricated from concrete and is of sufficient thickness to shield personnel operating the equipment from hazardous radiation. It should be appreciated that the left hand side of the apparatus as illustrated in FIG. 1 opens onto the reprocessing tanks and is subject to lethal amounts of radiation. The shielded enclosure includes a viewing port 14 which is a solid glass window. The top wall of the shielded enclosure has a maintenance cover 15 which is both alarmed and sealed so that any attempt to reach the sampler 5 would be brought to the attention of appropriate authorities.

Referring to FIG. 1, the sampler 5 includes a connector assembly that comprises a hook assembly, a pulling screw, and a frame assembly. The hook assembly includes three adzmuthally spaced apart hooks 17 that are mounted on a operating nut 19 by pins 18. The hooks can swing radially about the pins and are used in mounting the connector in the shielded enclosure. The operating unit 19 is engaged by a threaded operating screw 21. The operating screw is capped by a large hexagon shaped head designed to engage and be turned by a socket. The screw bears down against the frame assembly. The frame assembly includes a connector block 23 that contains a plurality of internal passages that connect to the exterior piping described below. The connector block is surmounted by a hook guide 27, FIG. 2 which urges the hooks together. The guide is attached to a conical skirt 26 by a plurality of tie bolts 24. The skirt 26 retains a conical gasket 25 within the connector block 23. The connector block, the hook guide, the skirt, and the gasket are all retained together in a rigid unitary assembly by the tie bolts.

The connector assembly of the sampler 5, FIG. 2 operates much like a wheel or a gear puller. The hooks 17 engage the collar 29 on the male connector 30 which is securely and rigidly mounted to the bottom wall of the shielded enclosure 8 and surrounded by a kickplate 33 to protect the concrete from the action of the hooks. The hooks are drawn together by the inner surface of the hook guide 27 which bears against the cam 31 formed on the outside surface of the hooks. The hooks pivot about the pins 18 which are connected to the operating nut 19. The operating screw 21 bears against the connector block 23 which forces the conical gasket 25 downward against the spherical seat 32 which is the top of the male connector 30.

When the nut on the top of the operating screw 21 is taken up, the hooks 17 are in turn pulled upward against the collar 29. In addition, the hook guide 27, the connector block 23, and the conical gasket 25 are urged downward against the spherical seat 32 of the male connector 30. In this way the sampler 5 is rigidly and securely mounted in the shielded enclosure.

A liquid sample is drawn up into the sampler 5, FIG. 1 from the reprocessing vessel, 7, FIG. 1 by a jet pump 36, FIG. 2. The jet pump operates on the venturi principle and contains no moving parts. The volume and pressure of air directed through the jet pump controls the amount of fluid drawn from the reprocessing vessel. The sample is sucked from the reprocessing vessel and travels up through an uptake 37, through the male connector 30, the connector block 23, and into pipe 38. The sample thereafter passes through a valve and needle assembly 39, FIG. 3 which is explained in detail below. The sample next passes through the jet pump and returns to the reprocessing vessel via the return line 40.

The jet pump 36, FIG. 2, is controlled by the volume and pressure of air admitted into the air conduit 42, FIGS. 1 and 2, from a supply of air (not shown) under pressure. The air is controlled by a globe valve 43 which is accessable to plant personnel at all times and a lockable gate valve 44 which is controlled by the time lock escapement 12. The lockable gate valve prevents actuation of the jet pump at all times except when permitted by the time lock. The air passes through the conduit 42, past the valves 43, 44, up the male connector 30 and through the air conduit 42, FIG. 2.

The valve and needle assembly 39, FIG. 3 includes a valve body 46 which is secured by two nuts to a mounting 47. The mounting is rigidly attached to the hook guide 27 of the frame assembly as illustrated in FIG. 1. The sample is drawn through the valve in the internal passage 48 from left to right as illustrated in FIG. 3. This internal passage can be blocked by a cylindrical stem 49 which is moved up and down by the valve operator 50, FIG. 1. The operator 50 is urged downward as shown in FIG. 4 by a spring (not shown). The internal passage also connects with a long hollow needle 51 and a corresponding short needle 52. These needles are located on either side of the seat of the stem and are not blocked by the stem.

Referring to FIG. 3, the sample bottle 9 is brought up under the valve and needle assembly 39 so that the two needles penetrate an elastomeric seal 54 in the top of the sample bottle and enter the bottle as shown in FIG. 3. The sample is drawn through the needle assembly by a jet pump which is connected to conduit 38′, FIG. 3. The valve in the assembly has two positions: a circulating position and a sampling position. In the circulating position the valve stem 49, FIG. 3 is elevated so that the sample can be drawn through the internal passage without restriction. This valve position permits the lines connecting the sampler to the reprocessing vessel to be rapidly flushed, thereby insuring that a fresh, representative sample is taken by the sampler. In the sampling position, the stem is lowered to block the passage. The sample then flows through the long needle 51 into the bottle.

When a sample is to be taken, the operator 50 is moved so that the stem 49 blocks the internal passage in the valve assembly as illustrated in FIG. 3. The jet pump suction then creates a low pressure in conduit 38′, the short needle 52, and in the sample bottle 9 because of the elastomeric seal 54. The sample is thus sucked through conduit 38′, and down the long needle 51 where it collects in the bottom of the bottle.

The sampling process is completed when the level of fluid in the bottle reaches the opening of the short needle 52. At this point the fluid begins to be drawn into the short needle and on to the jet pump through conduit 38′. The sample then runs back to the tank 7 via the return line 40. The use of short and long hollow needles thus prevents over filling of the sample bottles and, more importantly, insures that only a predetermined amount of sample can be placed in each sample bottle.

Referring to FIG. 1, the sample bottle 9 is carried in a radiation shield or pig 56 of conventional construction. The bottle and pig are elevated to the needles 51, 52 using an operating arm 57 which is actuated by a pneumatic (air) cylinder 58. Air pressure to the pneumatic cylinder is controlled by a globe valve 59 which is outside of the shielded enclosure and continuously accessable to plant personnel. The line between the globe valve and the pneumatic cylinder is also controlled by a lockable gate valve 60 which is actuated by the time lock escapement 12. In the same manner the operator 50, FIG. 1 for the valve and needle assembly 39 is actuated by an operating arm 62 of a pneumatic cylinder 63. This pneumatic cylinder is actuated by a globe valve 64 and is controlled by a lockable gate valve 65 which is likewise controlled by the time lock escapement 12. Access to the escapement 12 and the pneumatic cylinders 58, 63 is provided by a maintenance cover 66 that is both alarmed and sealed so that any attempt to reach this equipment would be brought to the attention of appropriate authorities.

Referring to FIG. 1, the apparatus includes a revolving tray 11 which turns about a vertical axis centered in the front wall of the shielding enclosure 8. The revolving tray translates the sample bottle 9 between the sampling position of FIG. 1 in the shielded enclosure and the secured position outside of the shielded enclosure. The motion of the revolving tray is controlled by an axle 67 which is regulated by the time lock escapement 12. The revolving tray contains only one opening for a pig 56 and the escapement limits the revolving tray to only swing through an arc of 180°. The revolving tray normally sits immobilized in the secured position with the opening for the pig located outside of the shielded enclosure.

When the time arrives to draw a sample, the time lock escapement 12 permits the axle to rotate the tray and to swing 180° so that a sample bottle 9 can be positioned under the needle and valve assembly 39. After the sample is taken, the time lock escapement permits a second 180° rotation back in the opposite direction so that the sample bottle is translated outside of the shielded enclosure for removal. Next the escapement immobilizes the tray for a period of time sufficient to minimize diversion. The escapement permits the tray to make only one cyclic translation between the periods of tray immobilization between the sampling position and the secured position.

It should be appreciated from FIG. 1 that the operating arms 57, 62 of the hydraulic cylinders can only be extended when in registration with the two bores in the revolving tray. When the tray is in the secured position, the operating arms cannot be extended because they are blocked by the tray.

It should further be appreciated that the axle 67, the position of the bores, and the width of the front wall of the shielded enclosure are dimensioned or offset so that a small tube cannot be passed around the revolving tray and manipulated into contact with the needles. The apparatus is designed so that fluid can only be withdrawn from the sampler via a sample bottle.

Further, the pig 56 is sized so that if it and the sample bottle 9 were replaced by a thin walled receptacle, the volume of such a replacement receptacle would still be sufficiently small to insure that only a minimum quantity of sample can be taken from the sampler during one sample cycle.

The time lock escapement 12, FIG. 1 itself is of conventional construction and is typical of the timing devices used for security installation such as vaults and safes. The escapement mechanism only permits rotation of the axle 67 and the tray 11 at predetermined periodic intervals. The escapement also limits the amount of time that the revolving tray is in the sampling position. The time lock also controls the opening of valves 44, 60, and 65 and thus prohibits actuation of the sampler except during predetermined intervals between periods of tray immobilization.

The time lock escapement is constructed to permit only one sample of radioactive fluid to be drawn during a predetermined interval. The duration of the interval is set depending on the volume of the sample, its level of activity, and the risk of diversion which is to be borne.

In operation, the revolving tray 11 normally sits in the secured position with the opening for receiving the sample bottle 9 and pig 56 positioned outside of the shielded enclosure 8. The valves 43, 44, 59, 60, 64 and 65 are closed and there is no sample flow through the conduits 37, 40.

Periodically when a sample is drawn, the time lock escapement 12 releases the axle 67 and permits the tray 11 to turn 180°. The bottle 9 is brought into position below the needle and valve assembly 39. The escapement also opens valve 60 which permits the operator to elevate the sample bottle up to the needles 51, 52 into the position shown in FIG. 3. Next, the time lock opens valve 44 and permits air to pass through valve 43 and actuate the air jet pump 36. The sample then is drawn up through conduit 37 and through the valve and needle assembly 39. The time lock also opens valve 65 so that the hydraulic cylinder 63 can be actuated to move the stem 49, FIG. 3 upward so that flow through the assembly can occur without restriction. In this configuration the sample fluid passes through the sampler at a rapid rate and all traces of previous samples are flushed from the line.

To draw a sample after flushing, the hydraulic cylinder 63 is actuated to move the operator 50 and to lower the stem 49, FIG. 3. The stem then blocks the internal passage 48 in the needle assembly and causes the flow to be directed down the long needle 51 and into the sample bottle 9.

Once the sample is drawn, the air control valve 43 is shut and the jet pump 36 is secured. The sampler is designed so that when the jet pump 36 is secured, all of the fluid in the sampler drains back by gravity to the reprocessing vessels 7. Next, the operating arms 57, 63 of the hydraulic cylinders are retracted so that the pig 56 and the sample bottle 9 are brought down into the revolving tray 11. The operator 50 is returned to the downward position as illustrated in FIG. 1 by a spring (not shown). Once the sample and pig are in the tray, the tray is rotated 180° back to the secured position for removal. The sample is thereafter taken to the laboratory for further processing. The time lock escapement 12 next shuts valves 44, 60, and 65 and locks the axle 67 so that the revolving tray 11 cannot be moved until the next sampling time is reached.

Other aspects, objects, and advantages of this invention can be obtained from a study of the drawings, the disclosure, and the appended claims.

I claim:

1. Apparatus for minimizing diversion of radioactive samples from a nuclear fuel sampling system, comprising:

(a) means for drawing a radioactive sample from a vessel containing nuclear fuel;

(b) a shielded enclosure surrounding the sample drawing means and having solid walls for shielding personnel from exposure to radiation and for preventing direct physical access to the sample drawing means;

(c) a tray located in a wall of the shielded enclosure for translating a sample vessel supported thereby between a sampling position in the shielded enclosure and a second position outside of the shielded enclosure, said tray being configured so that only one sample vessel can be translated between said positions;

(d) means for moving a sample vessel within the shielded enclosure between its supported position by the tray and a spaced position for receiving a radioactive sample from the sample drawing means;

(e) means interlocking said sample drawing means and said vessel moving means with said tray such that a sample can only be drawn and said vessel can only be moved from its supported position to its spaced position when said tray is in its sampling position; and (f) means connected to the tray for periodically immobilizing the tray in its secured position for a period of time sufficient to minimize diversion of radioactive samples.

2. An apparatus as in claim 1 wherein the tray is mounted on a vertical axle located in a side wall of the shielded enclosure and rotates in a 180° arc about a vertical axis between the sampling position and the secured position.

3. An apparatus as in claim 1 wherein the tray immobilizing means includes a time controlled escapement that permits the tray to make only one cyclic translation between periods of tray immobilization between the sampling position and the secured position.

4. An apparatus as in claim 1 wherein the sample drawing means and the sample vessel moving means are actuated by fluids that are controlled by lockable valves, said valves being periodically locked by the tray immobilizing means to prevent actuation of the sample drawing means and the sample vessel moving means.

5. An apparatus as in claim 1 wherein said interlocking means includes mechanical interlock means.

6. An apparatus for minimizing diversion of radioactive samples from a nuclear fuel sampling system, comprising:

(a) means for drawing a radioactive sample from a vessel containing spent nuclear fuel;

(b) a shielded enclosure surrounding the sample drawing means and having solid walls for shielding personnel from exposure to radiation and for preventing direct physical access to the sample drawing means;

(c) a tray located in a wall of the shielded enclosure for translating a sample vessel between a sampling position in the shielded enclosure and a secured position outside of the shielded enclosure;

(d) means for moving a sample vessel within the shielded enclosure between the tray and a position for receiving a radioactive sample from the sample drawing means, said moving means being operatively connected to the shielded enclosure and mechanically interlocked with said tray so that said vessel cannot be moved from the tray to its sample receiving position if the tray is not in its sampling position; and (e) means connected to the sample vessel moving means for periodically immobilizing the vessel moving means for a period of time sufficient to minimize diversion of radioactive samples.

7. An apparatus as in claim 6 including:

(a) an actuator forming part of said vessel moving means located with respect to the tray so that when the tray is in the secured position the actuator is blocked by the tray from operating and when the tray is in the sampling position the actuator is freed to move a sample vessel into position for receiving a sample from the sample drawing means; and (b) means connected to the tray for periodically immobilizing the tray for a period of time sufficient to minimize diversion of radioactive samples.

8. An apparatus as in claim 7 wherein the actuator includes an operating arm and wherein said tray has a bore for receiving therethrough the operating arm when in registration with said arm so that in the sampling position the operating arm must pass through the bore in the tray in order to move a sample vessel and in the secured position the operating arm is blocked by the tray because the bore and operating arm are not in registration.

9. An apparatus as in claim 6 wherein said immobilizing means includes a lockable valve which controls a fluid that actuates the sample vessel moving means, said valve being periodically locked by timing means to prevent actuation of the sample vessel moving means.

10. A method for minimizing diversion of radioactive samples from a nuclear fuel sampling system, comprising the steps of:

(a) translating a sample vessel into a shielded enclosure using a moveable tray, said shielded enclosure having solid walls for shielding personnel from exposure to radiation and for preventing direct physical access therein;

(b) drawing a radioactive sample in the shielded enclosure from a vessel containing nuclear fuel and depositing said sample in the sample vessel in the shielded enclosure;

(c) translating the sample vessel and the sample out of the shielded enclosure using the moveable tray for further processing; and (d) immobilizing the tray periodically with a time controlled escapement so that radioactive samples can only be drawn and removed from the shielded enclosure at a predetermined frequency thereby minimizing diversion.

11. A method as in claim 10 including the steps of:

(a) moving the sample vessel in the shielded enclosure using moving means; and (b) immobilizing the sample vessel moving means periodically with a time controlled escapement so that radioactive samples can only be moved within the shielded enclosure at a predetermined frequency.

12. A method as in claim 11 including the step of mechanically blocking the sample vessel moving means with the moveable tray thereby immobilizing the sample vessel moving means.

* * * * *